US010586647B2

(12) United States Patent
Takeda

(10) Patent No.: US 10,586,647 B2
(45) Date of Patent: Mar. 10, 2020

(54) ELECTRONIC COMPONENT

(71) Applicant: MURATA MANUFACTURING CO., LTD., Kyoto-fu (JP)

(72) Inventor: Yasushi Takeda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 88 days.

(21) Appl. No.: 15/708,231

(22) Filed: Sep. 19, 2017

(65) Prior Publication Data

US 2018/0090261 A1 Mar. 29, 2018

(30) Foreign Application Priority Data

Sep. 26, 2016 (JP) ..... 2016-187174

(51) Int. Cl.
*H01F 27/28* (2006.01)
*H01F 17/00* (2006.01)
(Continued)

(52) U.S. Cl.
CPC ..... *H01F 27/2804* (2013.01); *H01F 17/0013* (2013.01); *H01F 27/323* (2013.01);
(Continued)

(58) Field of Classification Search
CPC ..... H01F 2017/008
(Continued)

(56) References Cited

U.S. PATENT DOCUMENTS 7,907,044 B2 * 3/2011 Tada ..... H01F 17/0013 336/200
8,890,646 B2 * 11/2014 Noguchi ..... H01F 17/0013 336/200
(Continued)

FOREIGN PATENT DOCUMENTS

JP 2006-318946 A 11/2006
JP 2008078229 A 4/2008
(Continued)

OTHER PUBLICATIONS

An Office Action; "Notification of Reasons for Refusal," Mailed by the Japanese Patent Office dated Jan. 22, 2019, which corresponds to Japanese Patent Application No. 2016-187174 and is related to U.S. Appl. No. 15/708,231; with English language translation.
(Continued)

*Primary Examiner* — Ronald Hinson
(74) *Attorney, Agent, or Firm* — Studebaker & Brackett PC

(57) ABSTRACT

An electronic component includes an element assembly that includes a magnetic layer and a non-magnetic layer and a coil that is provided within the element assembly and that is wound in a spiral form. The coil includes a plurality of laminated layers of coil wires. The non-magnetic layer includes an inter-wire non-magnetic layer located between at least one pair of the coil wires that are adjacent in a lamination direction and a radial direction non-magnetic layer located on at least one of an outer side portion and an inner side portion in a radial direction of the coil. The radial direction non-magnetic layer is spaced apart from the inter-wire non-magnetic layer.

10 Claims, 12 Drawing Sheets

(51) Int. Cl.
*H01F 27/32* (2006.01)
*H01F 41/04* (2006.01)

(52) U.S. Cl.
CPC ..... *H01F 41/041* (2013.01); *H01F 2017/008* (2013.01); *H01F 2017/0066* (2013.01); *H01F 2027/2809* (2013.01)

(58) Field of Classification Search
USPC ..... 336/200
See application file for complete search history.

(56) References Cited

U.S. PATENT DOCUMENTS

| | | | | |
|---|---|---|---|---|
| 9,349,525 | B2 * | 5/2016 | Jeong | H01F 27/2804 |
| 2015/0228396 | A1 * | 8/2015 | Takeda | H01F 17/0013 336/200 |

FOREIGN PATENT DOCUMENTS

| | | | |
|---|---|---|---|
| JP | 2011-204899 | A | 10/2011 |
| JP | 2012160506 | A | 8/2012 |
| KR | 10-2009-0033378 | A | 4/2009 |
| KR | 10-2013-0116024 | A | 10/2013 |
| KR | 10-2013-0123632 | A | 11/2013 |

OTHER PUBLICATIONS

An Office Action issued by Korean Patent Office dated Sep. 15, 2018, which corresponds to Korean Patent Application No. 10-2017-0121795 and is related to U.S. Appl. No. 15/708,231; with English translation.

* cited by examiner

ELECTRONIC COMPONENT

CROSS REFERENCE TO RELATED APPLICATIONS

This application claims benefit of priority to Japanese Patent Application 2016-187174 filed Sep. 26, 2016, the entire content of which is incorporated herein by reference.

TECHNICAL FIELD

The present disclosure relates to electronic components.

BACKGROUND

Existing electronic components include the one described in Japanese Unexamined Patent Application Publication No. 2006-318946. This electronic component includes an element assembly that includes a magnetic layer and a non-magnetic layer and a coil that is provided within the element assembly and that is wound in a spiral form. The coil includes a plurality of laminated layers of coil wires. The non-magnetic layer includes an inter-wire portion located between the coil wires that are adjacent in the lamination direction and a radial direction outer side portion located in an outer side portion thereof in the radial direction of the coil.

It has been found that, when the existing electronic component described above is to be manufactured and used, a crack can appear in the inter-wire portion and the radial direction outer side portion of the non-magnetic layer. As a crack appears in the entirety of the non-magnetic layer in this manner, a problem arises in that the strength of the element assembly becomes insufficient.

SUMMARY

Accordingly, the present disclosure is directed to providing an electronic component with which the strength of an element assembly can be prevented from becoming insufficient.

To solve the problem described above, an electronic component according to preferred embodiments of the present disclosure includes an element assembly that includes a magnetic layer and a non-magnetic layer; and a coil that is provided within the element assembly and that is wound in a spiral form, wherein the coil includes a plurality of laminated layers of coil wires, wherein the non-magnetic layer includes an inter-wire non-magnetic layer located between at least one pair of the coil wires that are adjacent in a lamination direction and a radial direction non-magnetic layer located on at least one of an outer side portion and an inner side portion in a radial direction of the coil, and wherein the radial direction non-magnetic layer is spaced apart from the inter-wire non-magnetic layer.

The expression "the radial direction non-magnetic layer is spaced apart from the inter-wire non-magnetic layer" as used herein means that "the radial direction non-magnetic layer is not in contact with the inter-wire non-magnetic layer."

With the electronic component according to preferred embodiments of the present disclosure, since the radial direction non-magnetic layer is spaced apart from the inter-wire non-magnetic layer, even if a crack appears in the inter-wire non-magnetic layer, the crack in the inter-wire non-magnetic layer does not propagate to the radial direction non-magnetic layer. With this configuration, an occurrence of a crack in the radial direction non-magnetic layer can be suppressed, and the strength of the element assembly can be prevented from becoming insufficient.

In addition, in one embodiment of the electronic component, the coil wire is constituted by a plurality of laminated layers of coil conductor layers.

According to the stated embodiment, since the coil wire is constituted by the plurality of laminated layers of coil conductor layers, the resistance of the coil wire can be reduced.

In addition, in one embodiment of the electronic component, the coil wire is constituted by three or more laminated layers of coil conductor layers, and the radial direction non-magnetic layer is disposed in a plane in which, among the three or more coil conductor layers, a coil conductor layer located between coil conductor layers on both sides in a lamination direction is disposed.

According to the stated embodiment, since the radial direction non-magnetic layer is disposed in a plane in which the coil conductor layer located between the coil conductor layers on both sides in the lamination direction is disposed, the radial direction non-magnetic layer can be disposed so as to be further spaced apart from the inter-wire non-magnetic layer.

In addition, in one embodiment of the electronic component, the thickness of the coil wire is greater than the thickness of the radial direction non-magnetic layer.

According to the stated embodiment, since the thickness of the coil wire is greater than the thickness of the radial direction non-magnetic layer, the radial direction non-magnetic layer can be disposed so as to be further spaced apart from the inter-wire non-magnetic layer.

In addition, in one embodiment of the electronic component, the radial direction non-magnetic layer is located in the middle in the thickness direction of the coil wire.

According to the stated embodiment, since the radial direction non-magnetic layer is located in the middle in the thickness direction of the coil wire, the radial direction non-magnetic layer can be disposed so as to be further spaced apart from the inter-wire non-magnetic layer.

In addition, in one embodiment of the electronic component, the radial direction non-magnetic layer includes a plurality of layers.

According to the stated embodiment, since the radial direction non-magnetic layer includes a plurality of layers, the thickness of the radial direction non-magnetic layer can be increased, and the direct current superposition characteristics improve.

In addition, in one embodiment of the electronic component, the radial direction non-magnetic layers that are adjacent in the lamination direction are in contact with each other.

According to the stated embodiment, since the radial direction non-magnetic layers that are adjacent in the lamination direction are in contact with each other, the thickness of the radial direction non-magnetic layer can be increased, and the direct current superposition characteristics improve.

In addition, in one embodiment of the electronic component, the inter-wire non-magnetic layer includes a plurality of layers.

According to the stated embodiment, since the inter-wire non-magnetic layer includes a plurality of layers, even when a crack appears in the inter-wire non-magnetic layer, an occurrence of a short circuit fault can be prevented.

In addition, in one embodiment of the electronic component, a side surface of the plurality of layers of the inter-wire non-magnetic layers includes a concavity and a convexity, and the concavity and the convexity bite into the magnetic layer.

According to the stated embodiment, since the concavity and the convexity in the side surface of the plurality of layers of the inter-wire non-magnetic layers bite into the magnetic layer, the area in which the inter-wire non-magnetic layer and the magnetic layer are in contact with each other increases, and the close contact strength improves. With this configuration, peeling between the inter-wire non-magnetic layer and the magnetic layer can be suppressed.

In addition, in one embodiment of the electronic component, the thickness of the inter-wire non-magnetic layer is less than the thickness of the radial direction non-magnetic layer.

According to the stated embodiment, since the thickness of the inter-wire non-magnetic layer is less than the thickness of the radial direction non-magnetic layer, the coil length decreases, the alternating current loss increases, and the direct current superposition can be improved.

In addition, in one embodiment of the electronic component, the inter-wire non-magnetic layer is disposed between every pair of the coil wires that are adjacent in the lamination direction.

According to the stated embodiment, since the inter-wire non-magnetic layer is disposed between every pair of the coil wires that are adjacent in the lamination direction, the magnetic saturation becomes less likely to occur, and the inductance value can be further improved.

In addition, in one embodiment of the electronic component, a side surface of the coil wire includes a concavity and a convexity, and the concavity and the convexity bite into at least one of the magnetic layer and the radial direction non-magnetic layer.

According to the stated embodiment, since the concavity and the convexity in the side surface of the coil wire bite into at least one of the magnetic layer and the radial direction non-magnetic layer, the surface area of the coil wire increases, and the Q-value at a high-frequency wave can be improved despite the skin effect.

With the electronic component according to preferred embodiments of the present disclosure, since the radial direction non-magnetic layer is spaced apart from the inter-wire non-magnetic layer, an occurrence of a crack in the radial direction non-magnetic layer can be suppressed, and the strength of the element assembly can be prevented from becoming insufficient.

Other features, elements, characteristics and advantages of the present disclosure will become more apparent from the following detailed description of preferred embodiments of the present disclosure with reference to the attached drawings.

DETAILED DESCRIPTION

As described above, it has been found that a crack may appear in the non-magnetic layer in the existing electronic component. The inventor of the present application has diligently examined this phenomenon and found the following causes.

Specifically, when a magnetic layer, a non-magnetic layer, and a coil wire are laminated and pressed in manufacturing an electronic component, a crack appears in an inter-wire portion of the non-magnetic layer due to the difference in the Young's modulus between the coil wire and the non-magnetic layer. Thereafter, the crack in the inter-wire portion propagates to a radial direction outer side portion of the non-magnetic layer during firing. As a result, a crack appears in the radial direction outer side portion as well. In this manner, it has been found that, as a crack appears in the entirety of the non-magnetic layer, the strength of the element assembly becomes insufficient.

The present disclosure has been made on the basis of the above findings obtained independently by the inventor of the present application.

Hereinafter, the present disclosure will be described in detail on the basis of illustrated embodiments.

First Embodiment

Figure 1:
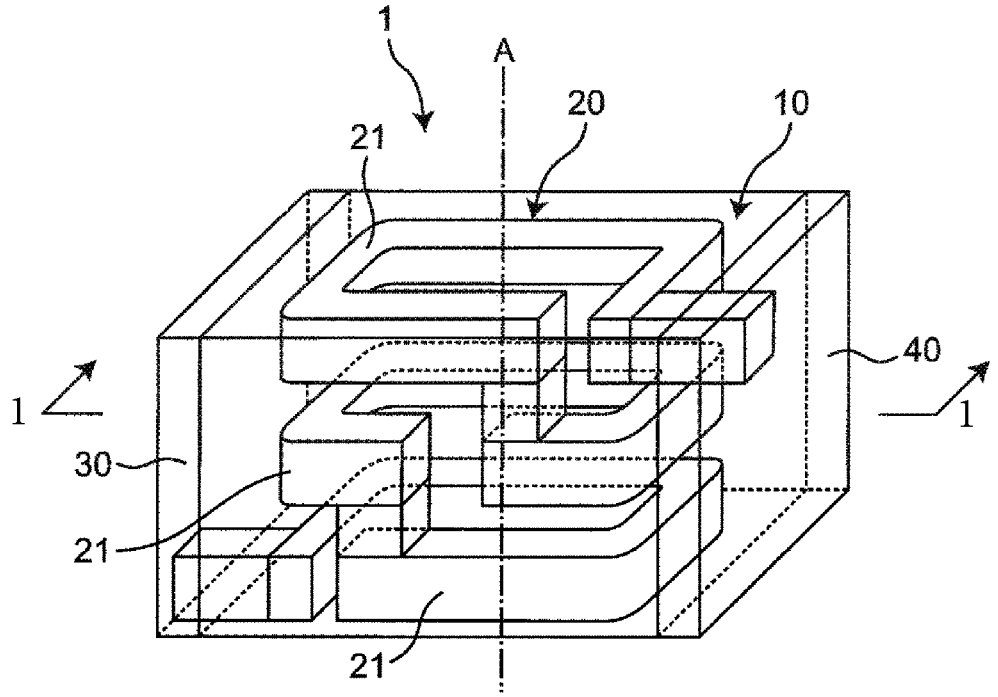
FIG. 1 is a perspective view illustrating a first embodiment of an electronic component according to the present disclosure.
Figure 2:
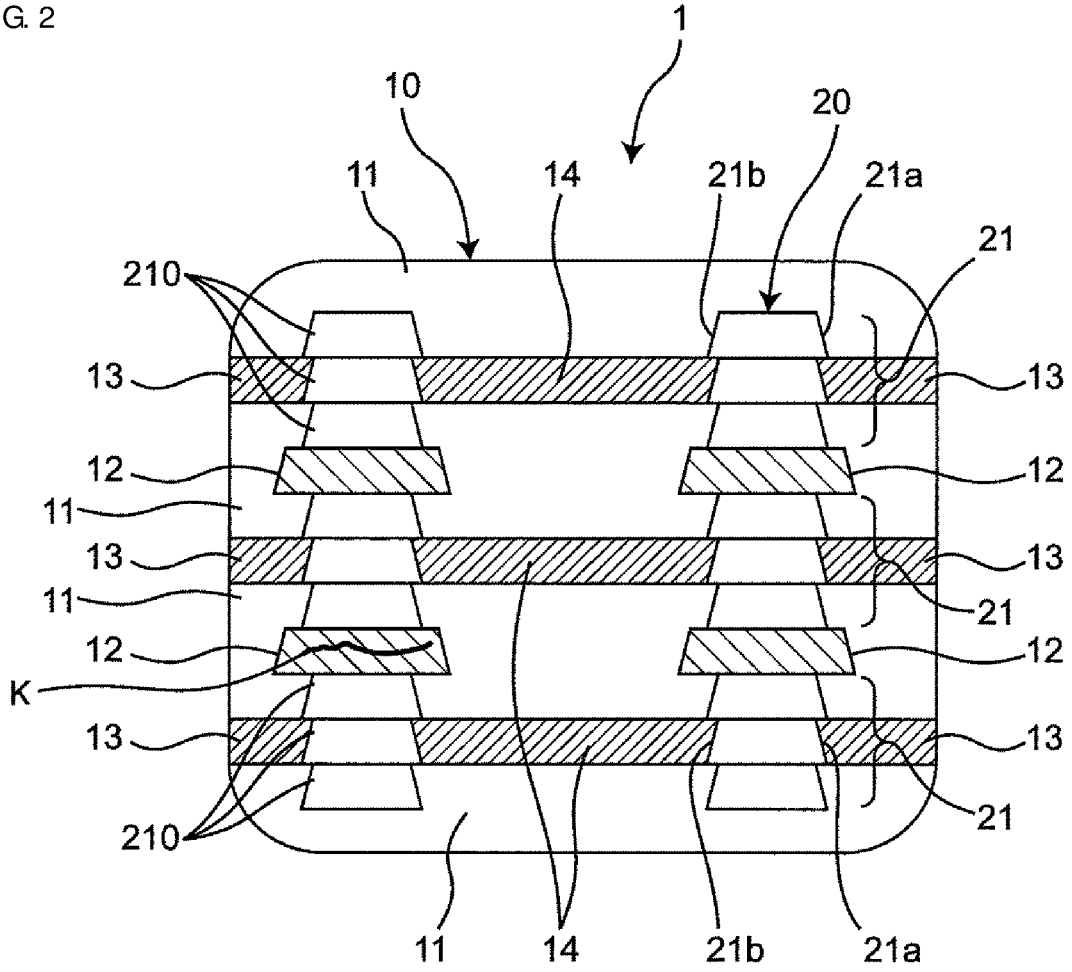
FIG. 2 is a sectional view along 1-1 indicated in FIG. 1.

FIG. 1 is a perspective view illustrating a first embodiment of an electronic component. FIG. 2 is a sectional view along 1-1 indicated in FIG. 1. As illustrated in FIG. 1 and FIG. 2, an electronic component 1 is a laminated inductor and includes an element assembly 10, a spiral coil 20 provided inside the element assembly 10, and a first outer electrode 30 and a second outer electrode 40 that are electrically connected to the coil 20 provided in the element assembly 10. In FIG. 1, the coil 20 is depicted in a solid line. In FIG. 2, the first outer electrode 30 and the second outer electrode 40 are omitted.

The electronic component 1 is electrically connected to a wire in or on a circuit board (not illustrated) with the first and second outer electrodes 30 and 40. The electronic component 1 is used, for example, as a noise removal filter and is used in an electronic device, such as a personal computer, a DVD player, a digital camera, a television set, a cellular phone, or car electronics. Aside from the above, the electronic component 1 may be used as a power inductor and is used, in this case, in a DC-DC converter portion built into a variety of electronic devices, for example.

The element assembly 10 is formed into a substantially rectangular parallelepiped shape. The element assembly 10 includes a first end surface, a second end surface that opposes the first end surface, and four side surfaces located between the first end surface and the second end surface.

The first outer electrode 30 and the second outer electrode 40 are formed, for example, of a conductive material, such as Ag or Cu. The first outer electrode 30 is provided on the first end surface side, and the second outer electrode 40 is provided on the second end surface side.

The coil 20 is formed, for example, of a conductive material, such as Ag or Cu. One end of the coil 20 is connected to the first outer electrode 30, and another end of the coil 20 is connected to the second outer electrode 40. An axis A of the coil 20 is disposed along the direction parallel to the first end surface and the second end surface. With this configuration, the first and second outer electrodes 30 and 40 do not interfere with the magnetic flux of the coil 20.

The coil 20 includes a plurality of coil wires 21 laminated along the axis A. The coil wires 21 are formed so as to be wound in a planar form. The coil wires 21 that are adjacent in the lamination direction are connected to each other with a connection wire extending in the lamination direction interposed therebetween. In this manner, the plurality of coil wires 21 are electrically connected to each other in series to form a spiral.

The element assembly 10 includes a magnetic layer 11 and non-magnetic layers 12, 13, and 14. The magnetic layer 11 and the non-magnetic layers 12, 13, and 14 are laminated along the axis A of the coil 20. The magnetic layer 11 is formed by using, for example, ferrite, such as Ni—Cu—Zn ferrite, Cu—Zn ferrite, or Ni—Cu—Zn—Mg ferrite. The non-magnetic layers 12, 13, and 14 are formed by using, for example, non-magnetic ferrite, such as Cu—Zn non-magnetic ferrite.

The non-magnetic layers 12, 13, and 14 include an inter-wire non-magnetic layer 12 located between at least one pair of the coil wires 21 that are adjacent in the lamination direction and radial direction non-magnetic layers 13 and 14 located on at least one of an outer side portion and an inner side portion in the radial direction of the coil 20. The radial direction non-magnetic layers 13 and 14 are spaced apart from the inter-wire non-magnetic layer 12. To be more specific, neither of the radial direction non-magnetic layers 13 and 14 is in contact with the inter-wire non-magnetic layer 12.

The inter-wire non-magnetic layer 12 can block the magnetic flux (magnetic flux of a small loop) generated around each coil wire 21. Therefore, the inter-wire non-magnetic layer can prevent a magnetic flux of a small loop from being superposed onto a magnetic flux (magnetic flux of a large loop) that is generated by all the coil wires 21 and passes through the center of all the coil wires 21 and can thus reduce an influence on the inductance.

The radial direction non-magnetic layers 13 and 14 are constituted by a radial direction outer side non-magnetic layer 13 located on the outer side portion in the radial direction of the coil 20 and a radial direction inner side non-magnetic layer 14 located on the inner side portion in the radial direction of the coil 20. The radial direction non-magnetic layers 13 and 14 can reduce an occurrence of magnetic saturation and improve the direct current superposition characteristics. The radial direction non-magnetic layers (each of the radial direction outer side non-magnetic layer 13 and the radial direction inner side non-magnetic layer 14) that oppose each other in the radial direction of each coil wire 21 are each formed by a single layer. The radial direction outer side non-magnetic layer 13 and the radial direction inner side non-magnetic layer 14 that oppose each other in the radial direction of each coil wire 21 are disposed in the same plane.

Here, the inter-wire non-magnetic layer 12 and the radial direction non-magnetic layers 13 and 14 do not include non-magnetic layers located in the same circuit planes as the coil wires 21. To be more specific, as illustrated in FIG. 1, each coil wire 21 has a gap in a portion thereof in the circumferential direction, and a non-magnetic layer may be provided in this gap. In other words, such a non-magnetic layer is located in the direction in which the coil wire 21 extends (in the same circuit plane). This non-magnetic layer differs from the inter-wire non-magnetic layer 12 and the radial direction non-magnetic layers 13 and 14. Thus, even if this non-magnetic layer is in contact with the inter-wire non-magnetic layer 12 and the radial direction non-magnetic layer 13 and 14, the inter-wire non-magnetic layer 12 is not in contact with and is spaced apart from the radial direction non-magnetic layers 13 and 14.

With the electronic component 1 described above, since the radial direction non-magnetic layers 13 and 14 are spaced apart from the inter-wire non-magnetic layer 12, even if a crack appears in the inter-wire non-magnetic layer 12, the crack in the inter-wire non-magnetic layer 12 does not propagate to the radial direction non-magnetic layers 13 and 14. With this configuration, an occurrence of a crack in the radial direction non-magnetic layers 13 and 14 can be suppressed, and the strength of the element assembly 10 can be prevented from becoming insufficient.

To be more specific, when the magnetic layer 11, the non-magnetic layers 12, 13, and 14, and the coil wires 21 are laminated and pressed in manufacturing the electronic component 1, a crack K may appear in the inter-wire non-magnetic layer 12 sandwiched between the coil wires 21 that are adjacent in the lamination direction due to the difference in the Young's modulus between the coil wires 21 and the non-magnetic layers 12, 13, and 14. Thereafter, since the radial direction non-magnetic layers 13 and 14 are not continuous with the inter-wire non-magnetic layer 12, the crack K in the inter-wire non-magnetic layer 12 does not propagate to the radial direction non-magnetic layers 13 and 14 during firing. As a result, the crack K does not appear in the radial direction non-magnetic layers 13 and 14.

In particular, since a crack does not appear in the radial direction outer side non-magnetic layer 13, the crack in the inter-wire non-magnetic layer 12 does not propagate to an outer side portion of the element assembly 10 via the radial direction outer side non-magnetic layer 13. Therefore, water can be prevented from entering into the element assembly 10 via a crack, and an occurrence of electrochemical migration in the coil wires 21 can be prevented. In contrast, in the exiting example (Japanese Unexamined Patent Application Publication No. 2006-318946), a crack also appears in the radial direction outer side portion of the non-magnetic layer, and thus the crack in the inter-wire portion of the non-magnetic layer propagates to an outer side portion of the element assembly 10 via the crack in the radial direction outer side portion. As a result, water enters into the element assembly 10 via the crack, and electrochemical migration in the coil wire occurs.

As illustrated in FIG. 2, the coil wire 21 is constituted by a plurality of laminated coil conductor layers 210. The coil conductor layers 210 are each formed to have a substantially trapezoidal sectional shape. In this manner, since the coil wire 21 is constituted by the plurality of coil conductor layers 210, the resistance of the coil wire 21 can be reduced.

To be more specific, the coil wire 21 is constituted by three laminated coil conductor layers 210, and the radial direction non-magnetic layers 13 and 14 are disposed in a plane in which, among the three coil conductor layers 210, the middle coil conductor layer 210 located between the coil conductor layers 210 on both sides in the lamination direction is disposed. With this configuration, the radial direction non-magnetic layers 13 and 14 can be disposed so as to be further spaced apart from the inter-wire non-magnetic layer 12.

It is to be noted that the coil wire may be constituted by four or more coil conductor layers and the radial direction non-magnetic layers may be disposed in a plane in which, among the four or more coil conductor layers, either one of the coil conductor layers located between the coil conductor layers on both sides in the lamination direction is disposed. Alternatively, the coil wire may be constituted by a single coil conductor layer, and in this case, the radial direction non-magnetic layers are formed to be thinner than the coil conductor layer to allow the radial direction non-magnetic layers to be spaced apart from the inter-wire non-magnetic layer.

In addition, the thickness of the coil wire 21 in the lamination direction is greater than the thickness of the radial direction non-magnetic layers 13 and 14 in the lamination direction. With this configuration, the radial direction non-magnetic layers 13 and 14 can be disposed so as to be further spaced apart from the inter-wire non-magnetic layer 12.

In addition, the radial direction non-magnetic layers 13 and 14 are located in the middle in the thickness direction of the coil wire 21. To be more specific, the center line of the radial direction non-magnetic layers 13 and 14 in the thickness direction coincides with the center line of the coil wire 21 in the thickness direction. With this configuration, the radial direction non-magnetic layers 13 and 14 can be disposed so as to be further spaced apart from the inter-wire non-magnetic layer 12.

In addition, the thickness of the inter-wire non-magnetic layer 12 may be made less than the thickness of the radial direction non-magnetic layers 13 and 14. With this configuration, the coil length is reduced, the alternating current loss is increased, and the direct current superposition can be improved.

In addition, the inter-wire non-magnetic layer 12 is disposed between every pair of the coil wires 21 that are adjacent in the lamination direction. With this configuration, the magnetic saturation is less likely to occur due to the inter-wire non-magnetic layers 12, and the inductance value can be improved.

In addition, the side surface of the coil wire 21 (the three coil conductor layers 210) includes an outer side surface 21*a* on the outer peripheral side in the radial direction and an inner side surface 21*b* on the inner peripheral side in the radial direction. The outer side surface 21*a* and the inner side surface 21*b* each include concavities and convexities constituted by concave portions and convex portions arrayed in an alternating manner in the lamination direction. The concavities and convexities in the side surfaces 21*a* and 21*b* of the coil wire 21 bite into the magnetic layer 11 and the radial direction non-magnetic layers 13 and 14. With this configuration, the surface area of the coil wire 21 increases, and the Q-value at a high-frequency wave can be improved despite the skin effect. It is to be noted that the concavities and convexities in the side surfaces 21*a* and 21*b* of the coil wire 21 may bite into at least one of the magnetic layer 11 and the radial direction non-magnetic layers 13 and 14.

Next, a method of manufacturing the electronic component 1 will be described.

Figure 3A:
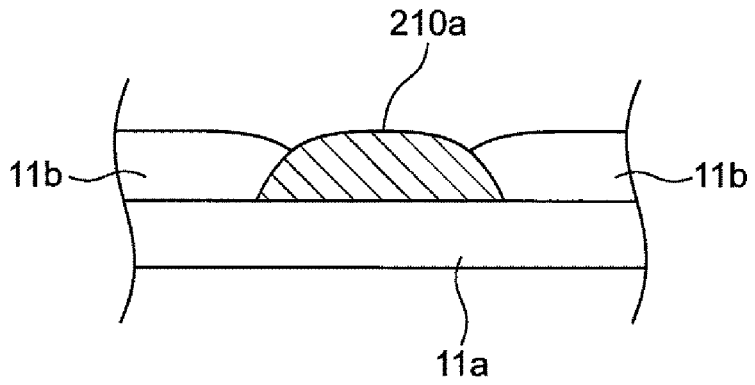
FIG. 3A is an illustration for describing a method of manufacturing the first embodiment of the electronic component.

As illustrated in FIG. 3A, a paste of a first coil conductor layer 210*a* is applied on a first magnetic layer 11*a* and dried. Then, a paste of a second magnetic layer 11*b* is applied on the first magnetic layer 11*a* and dried so as to cover both edge portions of the first coil conductor layer 210*a* and to expose the upper surface of the first coil conductor layer 210*a* other than both edge portions.

Figure 3B:
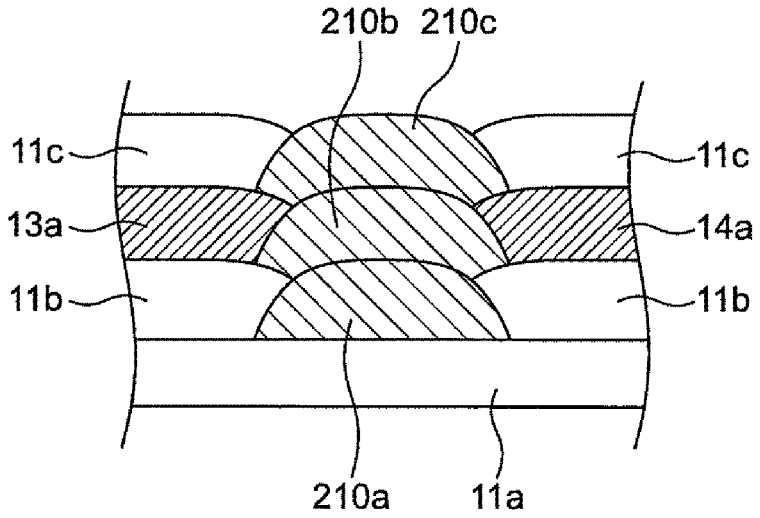
FIG. 3B is an illustration for describing a method of manufacturing the first embodiment of the electronic component.

Thereafter, as illustrated in FIG. 3B, a second coil conductor layer 210*b* is applied and dried so as to cover the upper surface of the first coil conductor layer 210*a* and to cover the edge portion of the second magnetic layer 11*b*. Thus, the second coil conductor layer 210*b* is superposed on the first coil conductor layer 210*a* as viewed in the lamination direction.

Then, a first radial direction outer side non-magnetic layer 13*a* is applied so as to cover the edge portion on the outer side portion of the second coil conductor layer 210*b* in the radial direction, and a first radial direction inner side non-magnetic layer 14*a* is applied so as to cover the edge portion on the inner side portion of the second coil conductor layer 210*b* in the radial direction.

Thereafter, a third coil conductor layer 210*c* is applied and dried so as to cover the upper surface of the second coil conductor layer 210*b* and to cover the edge portion of the first radial direction outer side non-magnetic layer 13*a* and the edge portion of the first radial direction inner side non-magnetic layer 14*a*. Thus, the third coil conductor layer 210*c* is superposed on the second coil conductor layer 210*b* as viewed in the lamination direction.

Then, a third magnetic layer 11*c* is applied on the first radial direction outer side non-magnetic layer 13*a* and the first radial direction inner side non-magnetic layer 14*a* and dried so as to cover both edge portions of the third coil conductor layer 210*c* and to expose the upper surface of the third coil conductor layer 210*c* other than both edge portions.

Figure 3C:
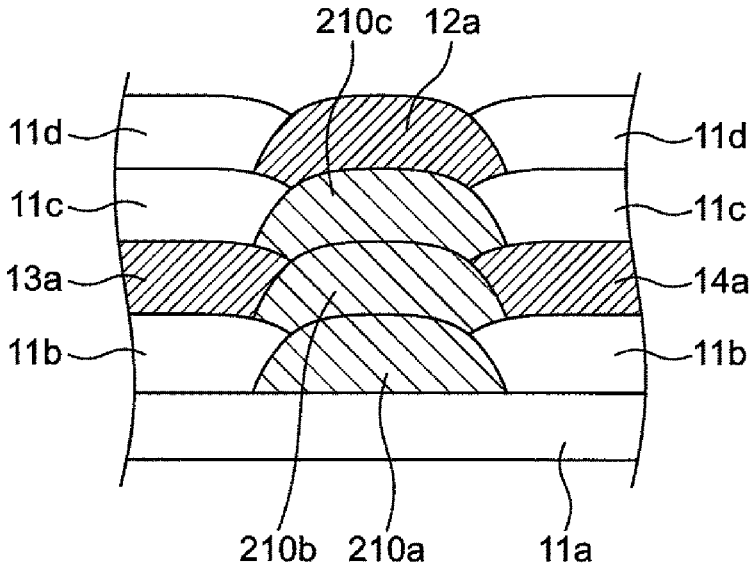
FIG. 3C is an illustration for describing a method of manufacturing the first embodiment of the electronic component.

Thereafter, as illustrated in FIG. 3C, a first inter-wire non-magnetic layer 12*a* is applied and dried so as to cover the upper surface of the third coil conductor layer 210*c* and to cover the edge portion of the third magnetic layer 11*c*. Thus, the first inter-wire non-magnetic layer 12*a* is superposed on the third coil conductor layer 210*c* as viewed in the lamination direction.

Then, a fourth magnetic layer 11*d* is applied on the third magnetic layer 11*c* and dried so as to cover both edge portions of the first inter-wire non-magnetic layer 12*a* and to expose the upper surface of the first inter-wire non-magnetic layer 12*a* other than both edge portions.

Figure 3D:
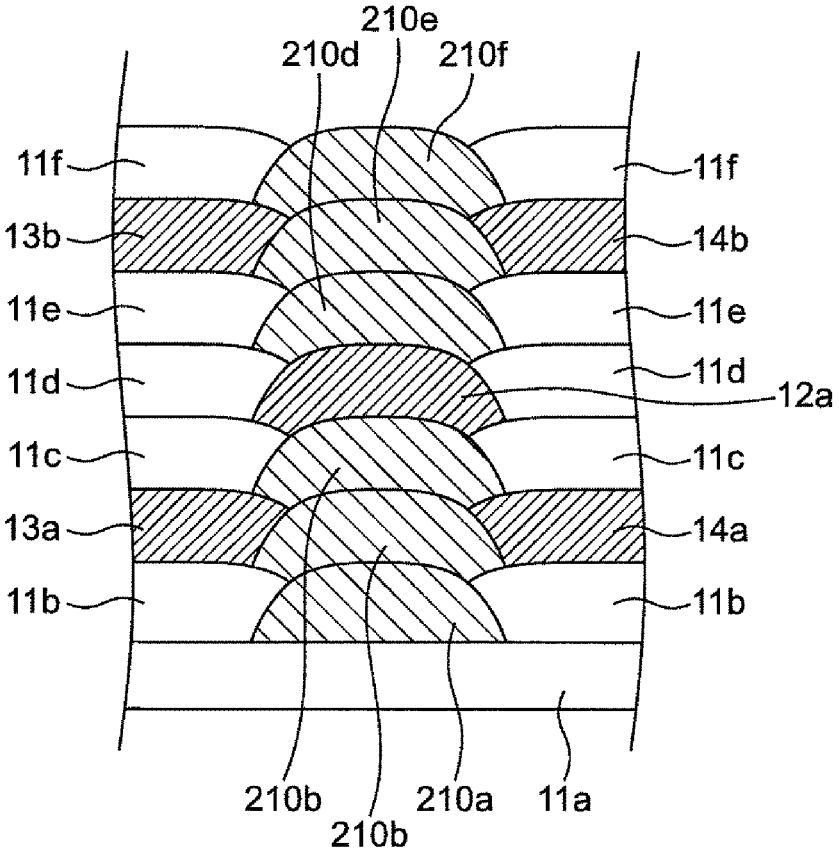
FIG. 3D is an illustration for describing a method of manufacturing the first embodiment of the electronic component.

Thereafter, a similar process is repeated, and as illustrated in FIG. 3D, a fourth coil conductor layer 210*d* and a fifth magnetic layer 11*e*; a fifth coil conductor layer 210*e*, a second radial direction outer side non-magnetic layer 13*b*, and a second radial direction inner side non-magnetic layer 14*b*; and a sixth coil conductor layer 210*f* and a sixth magnetic layer 11*f* are sequentially laminated. Furthermore, a similar process is repeated, and all the layers are laminated and pressed, which is then fired to manufacture the electronic component 1 illustrated in FIG. 2.

Second Embodiment

Figure 4:
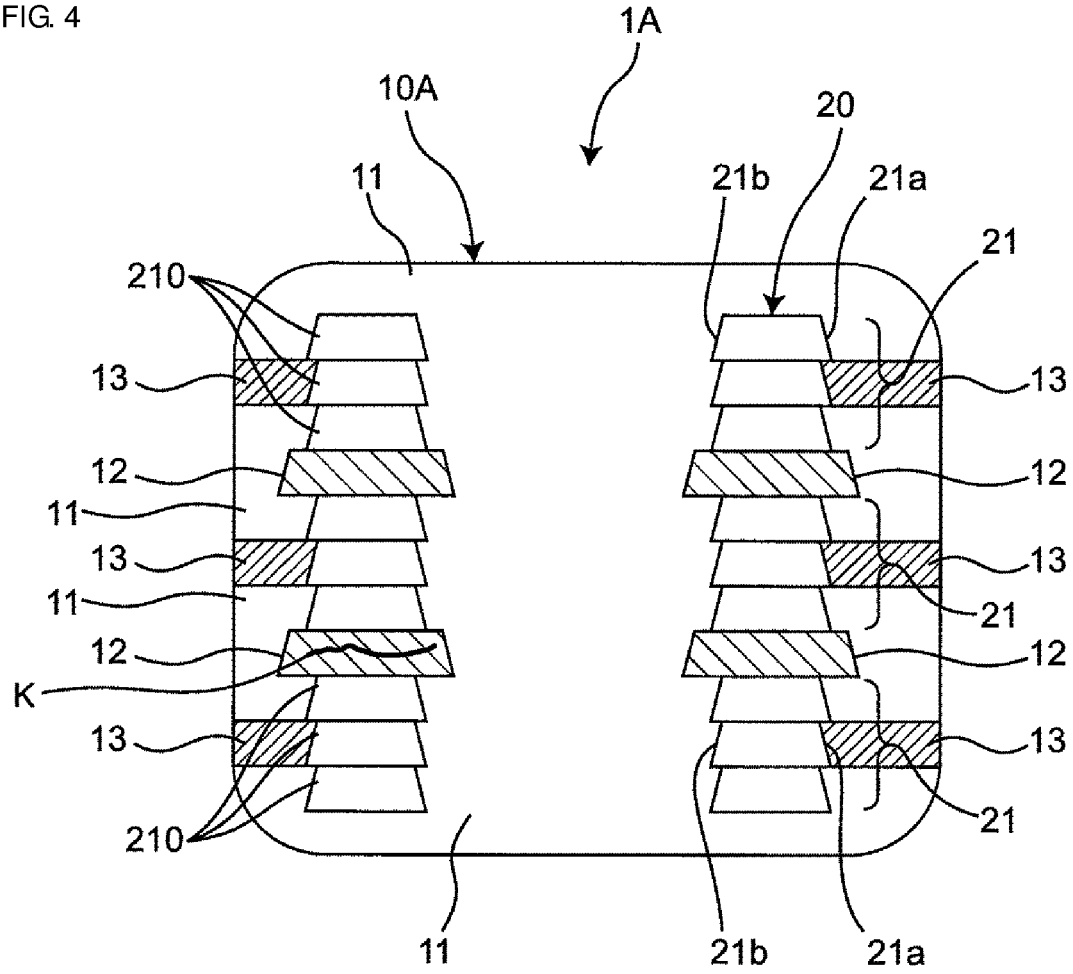
FIG. 4 is a sectional view illustrating a second embodiment of an electronic component according to the present disclosure.

FIG. 4 is a sectional view illustrating a second embodiment of an electronic component according to the present disclosure. The second embodiment differs from the first embodiment in terms of the configuration of an element assembly. This difference in the configuration will be described hereinafter. It is to be noted that, in the second embodiment, reference characters identical to those in the first embodiment refer to the same configurations as those in the first embodiment, and thus descriptions thereof will be omitted.

As illustrated in FIG. 4, a radial direction non-magnetic layer in an element assembly 10A of an electronic component 1A does not include the radial direction inner side non-magnetic layer 14 of the first embodiment and is constituted by the radial direction outer side non-magnetic layer 13. In a similar manner to the first embodiment, the radial direction outer side non-magnetic layer 13 is spaced apart from the inter-wire non-magnetic layer 12. In this manner, even when the radial direction inner side non-magnetic layer 14 is not provided, as the radial direction outer side non-magnetic layer 13 is provided, an effect of suppressing the magnetic saturation is obtained, and the direct current superposition characteristics can be improved.

Third Embodiment

Figure 5:
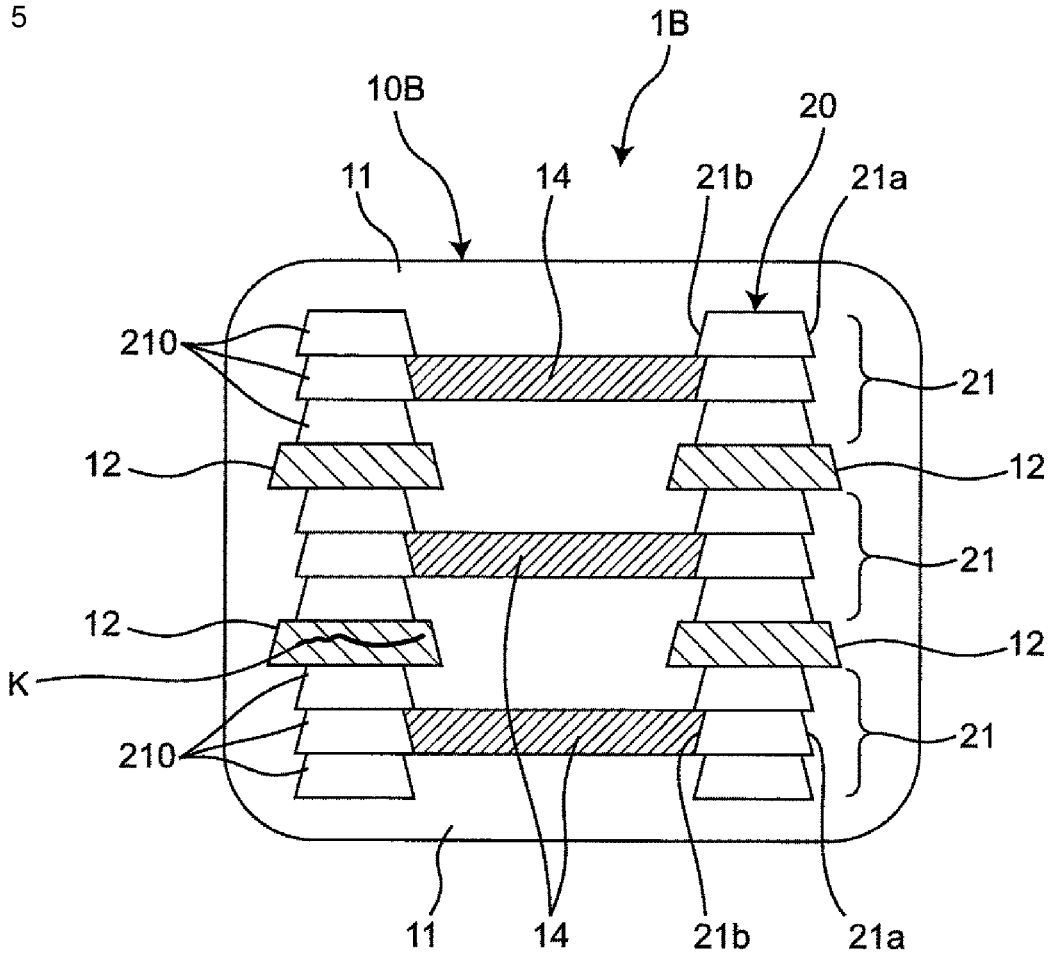
FIG. 5 is a sectional view illustrating a third embodiment of an electronic component according to the present disclosure.

FIG. 5 is a sectional view illustrating a third embodiment of an electronic component according to the present disclosure. The third embodiment differs from the first embodiment in terms of the configuration of an element assembly. This difference in the configuration will be described hereinafter. It is to be noted that, in the third embodiment, reference characters identical to those in the first embodiment refer to the same configurations as those in the first embodiment, and thus descriptions thereof will be omitted.

As illustrated in FIG. 5, a radial direction non-magnetic layer in an element assembly 10B of an electronic component 1B does not include the radial direction outer side non-magnetic layer 13 of the first embodiment and is constituted by the radial direction inner side non-magnetic layer 14. In a similar manner to the first embodiment, the radial direction inner side non-magnetic layer 14 is spaced apart from the inter-wire non-magnetic layer 12. In this manner, even when the radial direction outer side non-magnetic layer 13 is not provided, as the radial direction inner side non-magnetic layer 14 is provided, an effect of suppressing the magnetic saturation is obtained, and the direct current superposition characteristics can be improved.

Fourth Embodiment

Figure 6:
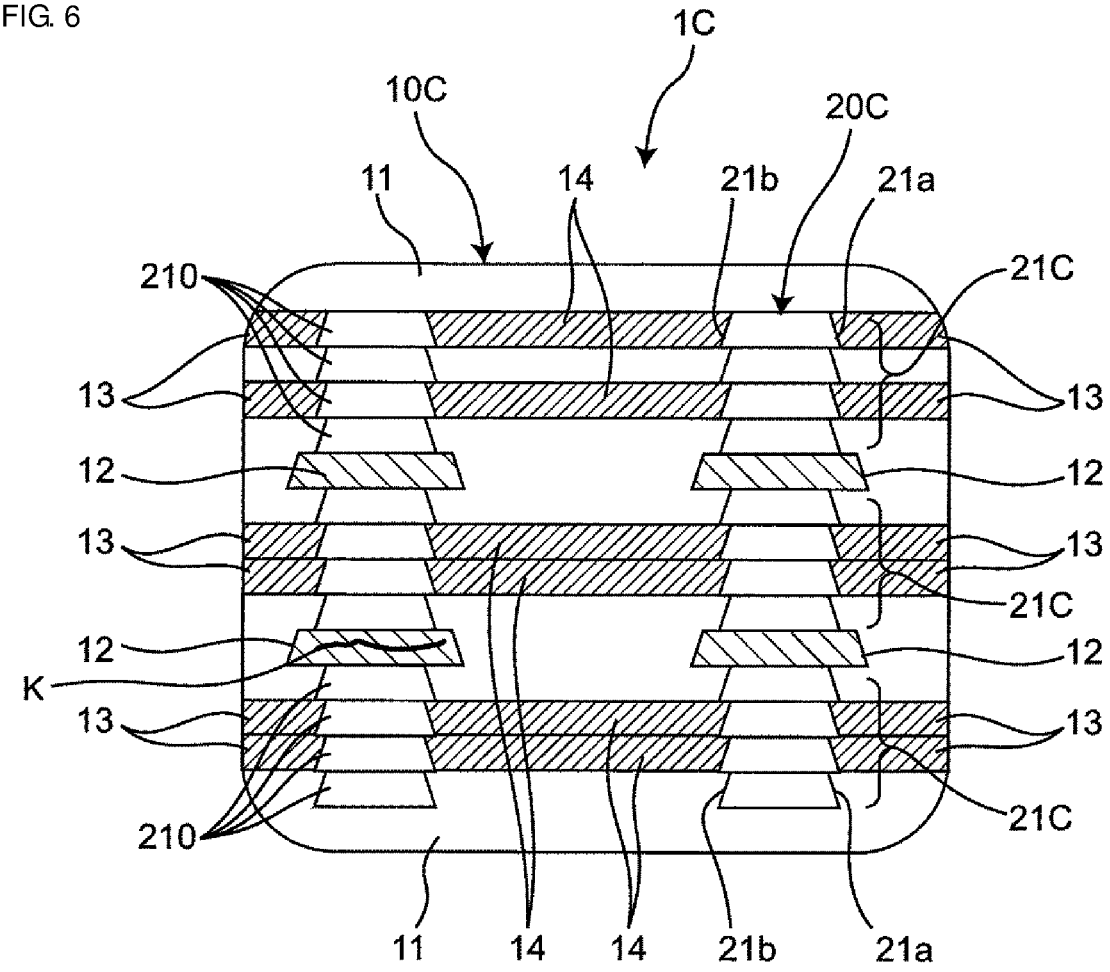
FIG. 6 is a sectional view illustrating a fourth embodiment of an electronic component according to the present disclosure.

FIG. 6 is a sectional view illustrating a fourth embodiment of an electronic component according to the present disclosure. The fourth embodiment differs from the first embodiment in terms of the configuration of an element assembly and a coil wire. This difference in the configuration will be described hereinafter. It is to be noted that, in the fourth embodiment, reference characters identical to those in the first embodiment refer to the same configurations as those in the first embodiment, and thus descriptions thereof will be omitted.

As illustrated in FIG. 6, in a coil 20C of an electronic component 1C, a coil wire 21C is constituted by four coil conductor layers 210. In addition, in an element assembly 10C of the electronic component 1C, the radial direction non-magnetic layers 13 and 14 that oppose each other in the radial direction of each of the coil wires 21C are constituted by a plurality of layers. To be more specific, the radial direction outer side non-magnetic layer 13 and the radial direction inner side non-magnetic layer 14 that oppose each other in the radial direction of each coil wire 21C are each constituted by two layers. The two radial direction outer side non-magnetic layers 13 are adjacent to each other in the lamination direction. The two radial direction inner side non-magnetic layers 14 are adjacent to each other in the lamination direction.

In the radial direction non-magnetic layers 13 and 14 that oppose each other in the radial direction of the coil wire 21C on the lowermost side, the two radial direction outer side non-magnetic layers 13 that are adjacent in the lamination direction are in contact with each other, and the two radial direction inner side non-magnetic layers 14 that are adjacent in the lamination direction are in contact with each other.

In the radial direction non-magnetic layers 13 and 14 that oppose each other in the radial direction of the coil wire 21C in the middle, the two radial direction outer side non-magnetic layers 13 that are adjacent in the lamination direction are in contact with each other, and the two radial direction inner side non-magnetic layers 14 that are adjacent in the lamination direction are in contact with each other.

In the radial direction non-magnetic layers 13 and 14 that oppose each other in the radial direction of the coil wire 21C on the uppermost side, the two radial direction outer side non-magnetic layers 13 that are adjacent in the lamination direction are spaced apart from each other, and the two radial direction inner side non-magnetic layers 14 that are adjacent in the lamination direction are spaced apart from each other.

Therefore, since the radial direction non-magnetic layers 13 and 14 that oppose each other in the radial direction of each coil wire 21C are constituted by a plurality of layers, the thickness of the radial direction non-magnetic layers 13 and can be increased, and the direct current superposition characteristics improve. It is to be noted that the radial direction non-magnetic layers that oppose in the radial direction of at least one coil wire 21C may be constituted by a plurality of layers.

Fifth Embodiment

Figure 7:
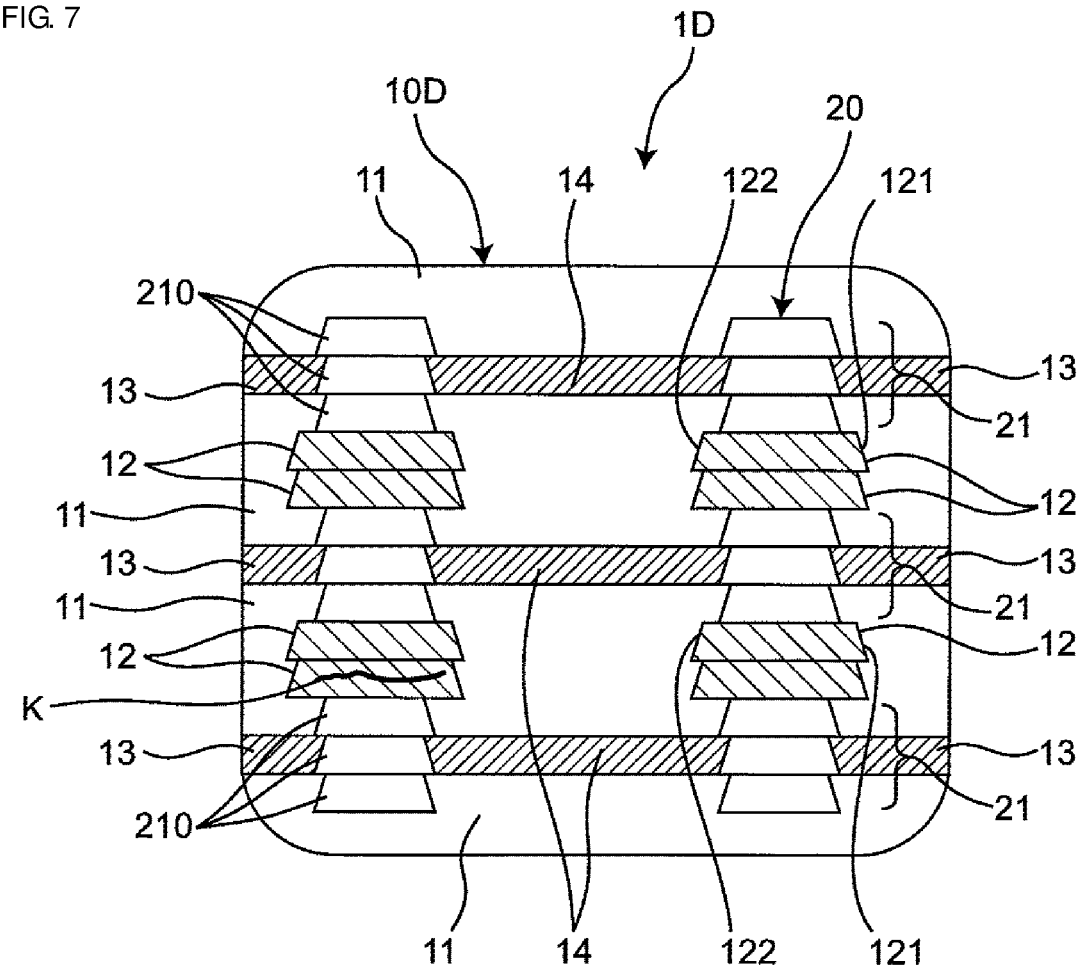
FIG. 7 is a sectional view illustrating a fifth embodiment of an electronic component according to the present disclosure.

FIG. 7 is a sectional view illustrating a fifth embodiment of an electronic component according to the present disclosure. The fifth embodiment differs from the first embodiment in terms of the configuration of an element assembly. This difference in the configuration will be described hereinafter. It is to be noted that, in the fifth embodiment, reference characters identical to those in the first embodiment refer to the same configurations as those in the first embodiment, and thus descriptions thereof will be omitted.

As illustrated in FIG. 7, in an element assembly 10D of an electronic component 1D, the inter-wire non-magnetic layer 12 located between every pair of the coil wires 21 is constituted by a plurality of layers. To be more specific, the inter-wire non-magnetic layer 12 disposed between the coil wires 21 is constituted by two layers. Therefore, even if a crack K appears in one layer in the inter-wire non-magnetic layer 12, an occurrence of a short circuit fault can be prevented by the other layer in the inter-wire non-magnetic layer 12. It is to be noted that the inter-wire non-magnetic layer located between at least one pair of the coil wires may be constituted by a plurality of layers.

In addition, the side surface of the plurality of layers in the inter-wire non-magnetic layer 12 includes an outer side surface 121 on the outer peripheral side in the radial direction and an inner side surface 122 on the inner peripheral side in the radial direction. The outer side surface 121 and the inner side surface 122 each include concavities and convexities constituted by concave portions and convex portions arrayed in an alternating manner in the lamination direction. The concavities and convexities in the side surfaces 121 and 122 of the plurality of layers in the inter-wire non-magnetic layer bite into the magnetic layer 11. Therefore, the area in which the inter-wire non-magnetic layer 12 and the magnetic layer 11 are in contact with each other increases, and the close contact strength improves. With this configuration, peeling between the inter-wire non-magnetic layer 12 and the magnetic layer 11 can be suppressed.

Sixth Embodiment

Figure 8:
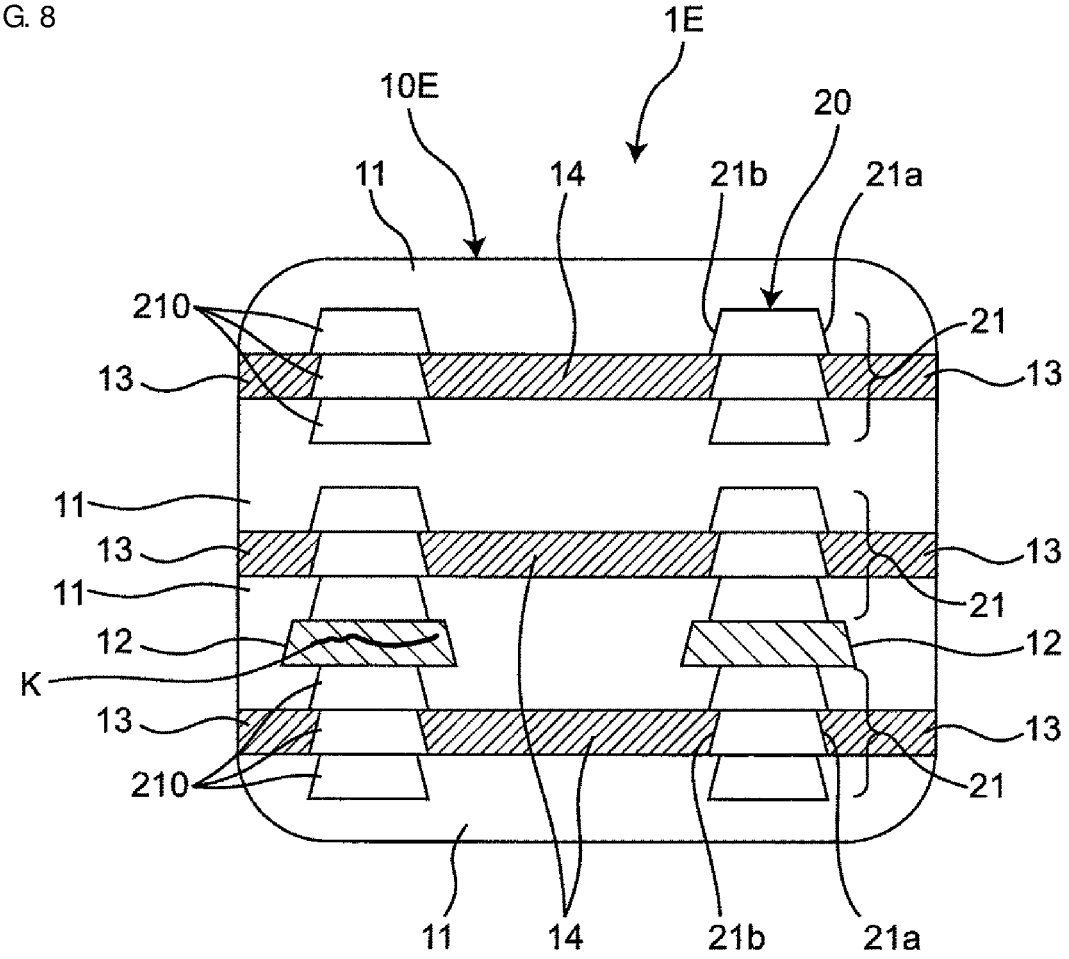
FIG. 8 is a sectional view illustrating a sixth embodiment of an electronic component according to the present disclosure.

FIG. 8 is a sectional view illustrating a sixth embodiment of an electronic component according to the present disclosure. The sixth embodiment differs from the first embodiment in terms of the configuration of an element assembly. This difference in the configuration will be described hereinafter. It is to be noted that, in the sixth embodiment, reference characters identical to those in the first embodiment refer to the same configurations as those in the first embodiment, and thus descriptions thereof will be omitted.

As illustrated in FIG. 8, in an element assembly 10E of an electronic component 1E, the inter-wire non-magnetic layer 12 is provided between one pair of the coil wires 21, instead of being provided between every pair (two pairs) of the coil wires that are adjacent in the lamination direction. In this manner, instead of providing the inter-wire non-magnetic layer 12 between every pair of the coil wires 21, the inter-wire non-magnetic layer 12 may be provided between one pair of the coil wires 21. Nevertheless, an effect of suppressing the magnetic saturation can be obtained, and the inductance value can be improved.

Seventh Embodiment

Figure 9:
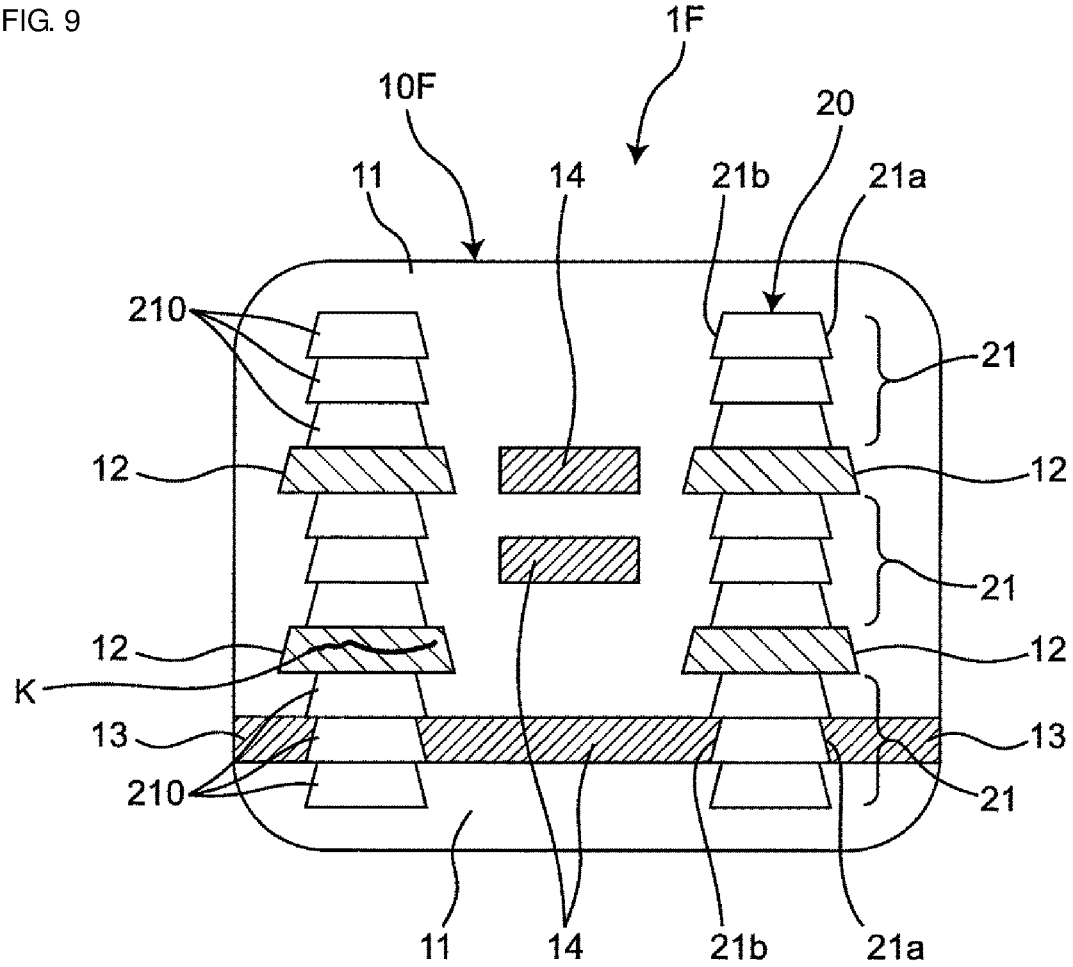
FIG. 9 is a sectional view illustrating a seventh embodiment of an electronic component according to the present disclosure.

FIG. 9 is a sectional view illustrating a seventh embodiment of an electronic component according to the present disclosure. The seventh embodiment differs from the first embodiment in terms of the configuration of an element assembly. This difference in the configuration will be described hereinafter. It is to be noted that, in the seventh embodiment, reference characters identical to those in the first embodiment refer to the same configurations as those in the first embodiment, and thus descriptions thereof will be omitted.

As illustrated in FIG. 9, in an element assembly 10F of an electronic component 1F, some of the radial direction non-magnetic layers 13 and 14 are not in contact with the coil wires 21. To be more specific, the radial direction non-magnetic layers that oppose each other in the radial direction of the coil wire 21 in the middle in the lamination direction are constituted by the radial direction inner side non-magnetic layer 14, and the radial direction inner side non-magnetic layer 14 is spaced apart from the coil wire 21. In other words, this radial direction inner side non-magnetic layer 14 is smaller along the plane direction orthogonal to the lamination direction than the radial direction inner side non-magnetic layer of the first embodiment. In addition, the radial direction outer side non-magnetic layer 13 is not provided in the plane in which the aforementioned radial direction inner side non-magnetic layer 14 is provided.

In addition, the radial direction non-magnetic layer that opposes the inter-wire non-magnetic layer 12 between the coil wire 21 in the middle and the coil wire 21 on the uppermost side is constituted by the radial direction inner side non-magnetic layer 14, and the radial direction inner side non-magnetic layer 14 is, of course, spaced apart from the inter-wire non-magnetic layer 12. The radial direction outer side non-magnetic layer 13 is not provided in the plane in which this radial direction inner side non-magnetic layer 14 is provided.

In addition, the radial direction non-magnetic layers that oppose each other in the radial direction of the coil wire 21 on the lowermost side are constituted by the radial direction outer side non-magnetic layer 13 and the radial direction inner side non-magnetic layer 14, in a similar manner to the first embodiment, and the radial direction outer side non-magnetic layer 13 and the radial direction inner side non-magnetic layer 14 are in contact with the coil wire 21.

In this manner, even if the size of some of the radial direction inner side non-magnetic layers 14 in the plane direction is reduced, an effect of suppressing the magnetic saturation can be obtained, and the direct current superposition characteristics can be improved. In addition, even if some of the radial direction outer side non-magnetic layers 13 are omitted, an effect of suppressing the magnetic saturation can be obtained, and the direct current superposition characteristics can be improved.

Eighth Embodiment

Figure 10:
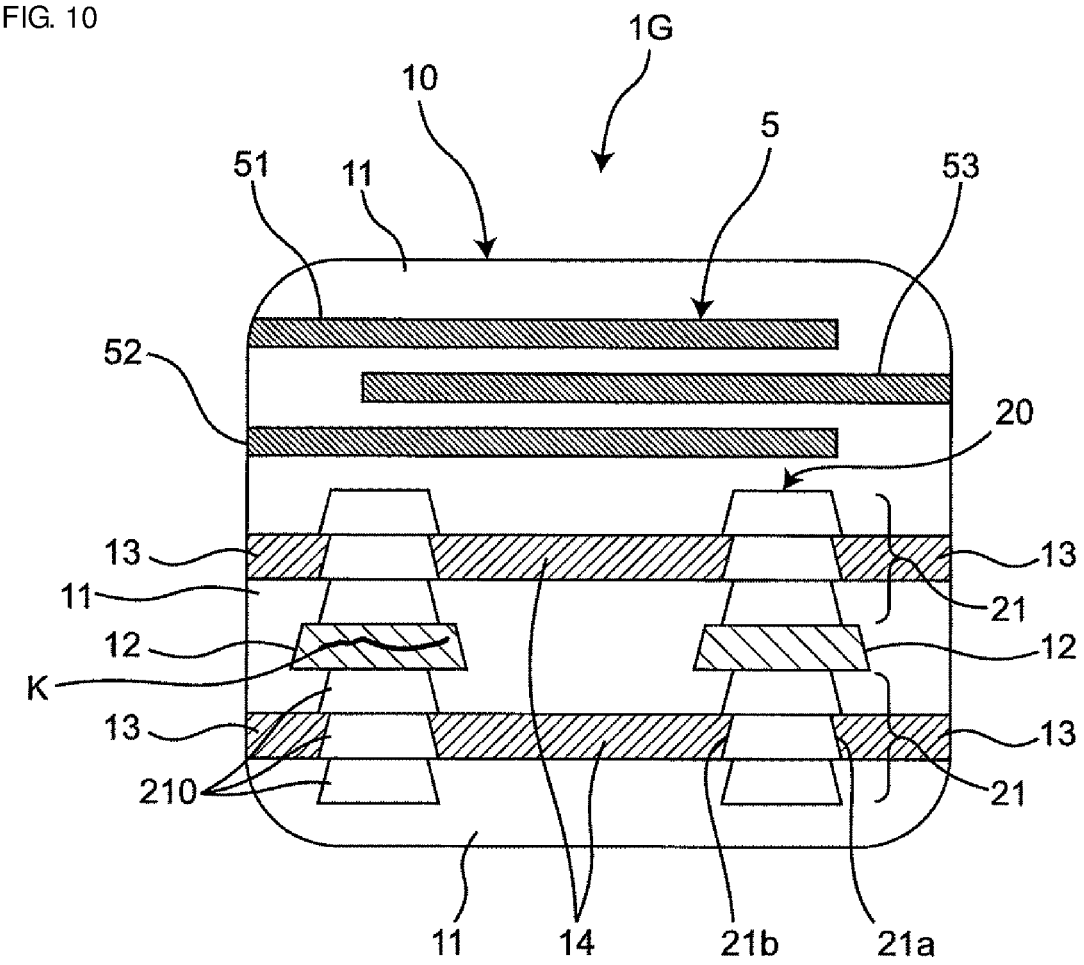
FIG. 10 is a sectional view illustrating an eighth embodiment of an electronic component according to the present disclosure.

FIG. 10 is a sectional view illustrating an eighth embodiment of an electronic component according to the present disclosure. The eighth embodiment differs from the first embodiment in terms of the configuration that includes a capacitor. This difference in the configuration will be described hereinafter. It is to be noted that, in the eighth embodiment, reference characters identical to those in the first embodiment refer to the same configurations as those in the first embodiment, and thus descriptions thereof will be omitted.

As illustrated in FIG. 10, an electronic component 1G includes a capacitor 5 in addition to the coil 20. The capacitor 5 includes a first electrode layer 51, a second electrode layer 52, and a third electrode layer 53, which are laminated in the lamination direction. The third electrode layer 53 is disposed between the first electrode layer 51 and the second electrode layer 52 so as to be spaced apart from the first electrode layer 51 and the second electrode layer 52.

The first electrode layer 51 is electrically connected to one end of the coil 20, the second electrode layer 52 is electrically connected to another end of the coil 20, and the third electrode layer 53 is connected to the ground. With this configuration, the first electrode layer 51 and the third electrode layer 53 function as a capacitor that is electrically connected to the one end of the coil 20, the second electrode layer 52 and the third electrode layer 53 function as a capacitor that is electrically connected to the other end of the coil 20, and the electronic component 1G functions as an LC filter.

Therefore, even when the electronic component 1G is constituted as an LC filter, since the radial direction non-magnetic layers 13 and 14 are spaced apart from the inter-wire non-magnetic layer 12, an occurrence of a crack in the radial direction non-magnetic layers 13 and 14 can be suppressed, and the strength of the element assembly 10 can be prevented from becoming insufficient.

Ninth Embodiment

Figure 11:
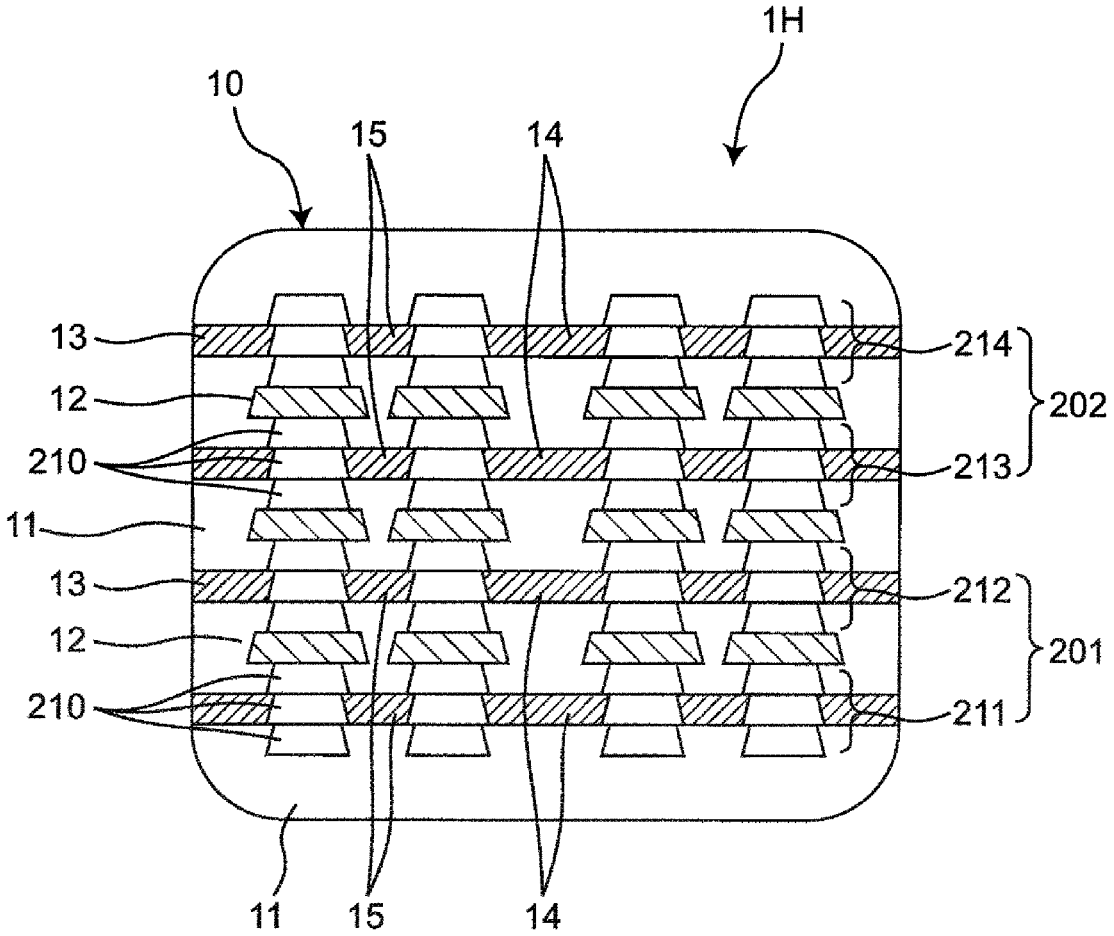
FIG. 11 is a sectional view illustrating a ninth embodiment of an electronic component according to the present disclosure.

FIG. 11 is a sectional view illustrating a ninth embodiment of an electronic component according to the present disclosure. The ninth embodiment differs from the first embodiment in terms of the number of coils. This difference in the configuration will be described hereinafter. It is to be noted that, in the ninth embodiment, reference characters identical to those in the first embodiment refer to the same configurations as those in the first embodiment, and thus descriptions thereof will be omitted.

As illustrated in FIG. 11, an electronic component 1H includes a first coil 201 and a second coil 202. The first coil 201 and the second coil 202 are disposed so as to be concentric and are magnetically coupled. In other words, the electronic component 1H functions as a common mode choke coil.

The first coil 201 includes a first coil wire 211 and a second coil wire 212. The first coil wire 211 and the second coil wire 212 are disposed so as to be concentric. The first coil wire 211 and the second coil wire 212 are each formed into a planar spiral form. The first coil wire 211 and the second coil wire 212 are connected in series with a connection conductor (not illustrated) interposed therebetween. The first coil wire 211 and the second coil wire 212 are each constituted by three coil conductor layers 210.

The second coil 202 includes a third coil wire 213 and a fourth coil wire 214. The third coil wire 213 and the fourth coil wire 214 are disposed so as to be concentric. The third coil wire 213 and the fourth coil wire 214 are each formed into a planar spiral form. The third coil wire 213 and the fourth coil wire 214 are connected in series with a connection conductor (not illustrated) interposed therebetween. The third coil wire 213 and the fourth coil wire 214 are each constituted by three coil conductor layers 210.

In a similar manner to the first embodiment, the inter-wire non-magnetic layer 12 is provided between the first coil wire 211 and the second coil wire 212, between the second coil wire 212 and the third coil wire 213, and between the third coil wire 213 and the fourth coil wire 214. In addition, the radial direction inner side non-magnetic layer 14 is provided on the inner side portion of each of the first coil 201 and the second coil 202 in the radial direction, and the radial direction outer side non-magnetic layer 13 is provided on the outer side portion of each of the first coil 201 and the second coil 202 in the radial direction. The radial direction inner side non-magnetic layer 14 and the radial direction outer side non-magnetic layer 13 are spaced apart from the inter-wire non-magnetic layer 12.

Furthermore, a wire pitch non-magnetic layer 15 is provided in each of the first coil 201 and the second coil 202. To be more specific, the wire pitch non-magnetic layer 15 is provided between the pitches of the wires in the first coil wire 211. The wire pitch non-magnetic layer 15 is formed of the same material as the material for the radial direction non-magnetic layers 13 and 14. The same applies to the second coil wire 212, the third coil wire 213, and the fourth coil wire 214. The wire pitch non-magnetic layer 15 is spaced apart from the inter-wire non-magnetic layer 12.

Therefore, even when the electronic component 1H is constituted as a common mode choke coil, since the radial direction non-magnetic layers 13 and 14 and the wire pitch non-magnetic layer 15 are spaced apart from the inter-wire non-magnetic layer 12, an occurrence of a crack in the radial direction non-magnetic layers 13 and 14 and the wire pitch non-magnetic layer 15 can be suppressed, and the strength of the element assembly 10 can be prevented from becoming insufficient.

It is to be noted that the present disclosure is not limited to the embodiments described above, and various design changes can be made within the scope that does not depart from the spirit of the present disclosure. For example, the characteristic points of each of the first to ninth embodiments may be combined in a variety of patterns.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component, comprising:

an element assembly that includes a magnetic layer and a non-magnetic layer; and a coil that is provided within the element assembly and that is wound in a spiral form, wherein the coil includes a plurality of laminated layers of coil wires, wherein the non-magnetic layer includes an inter-wire non-magnetic layer located between at least one pair of the coil wires that are adjacent in a lamination direction, and a radial direction non-magnetic layer located on at least one of an outer side portion and an inner side portion in a radial direction of the coil, wherein the radial direction non-magnetic layer is spaced apart from the inter-wire non-magnetic layer, wherein the coil wire is constituted by three or more laminated layers of coil conductor layers, and wherein the radial direction non-magnetic layer is disposed in a plane in which, among the three or more coil conductor layers, a coil conductor layer located between coil conductor layers on both sides in a lamination direction is disposed.

2. The electronic component according to claim 1, wherein a thickness of the inter-wire non-magnetic layer is less than a thickness of the radial direction non-magnetic layer.

3. The electronic component according to claim 1, wherein the inter-wire non-magnetic layer is disposed between every pair of the coil wires that are adjacent in the lamination direction.

4. The electronic component according to claim 1, wherein a side surface of the coil wire includes a concavity and a convexity, and the concavity and the convexity are formed in at least one of the magnetic layer and the radial direction non-magnetic layer.

5. The electronic component according to claim 1, wherein the thickness of the coil wire is greater than the thickness of the radial direction non-magnetic layer.

6. The electronic component according to claim 5, wherein the radial direction non-magnetic layer is located in the middle in the thickness direction of the coil wire.

7. The electronic component according to claim 1, wherein the radial direction non-magnetic layer includes a plurality of layers.

8. The electronic component according to claim 7, wherein the radial direction non-magnetic layers that are adjacent in the lamination direction are in contact with each other.

9. The electronic component according to claim 1, wherein the inter-wire non-magnetic layer includes a plurality of layers.

10. The electronic component according to claim 9, wherein a side surface of the plurality of inter-wire non-magnetic layers includes a concavity and a convexity, and the concavity and the convexity are formed in the magnetic layer.

* * * * *